United States Patent [19]

Chumley et al.

[11] 4,322,588

[45] Mar. 30, 1982

[54] SLIDE SELECTOR SWITCH DEVICE

[75] Inventors: Calvin L. Chumley, St. Louis County; William W. Hendrickson, St. Charles; Leon P. Mace, St. Louis, all of Mo.

[73] Assignee: UMC Industries, Inc., Stamford, Conn.

[21] Appl. No.: 137,534

[22] Filed: Apr. 4, 1980

[51] Int. Cl.[3] ..... H01H 15/08; H01H 15/10; H01H 15/16

[52] U.S. Cl. ..... 200/5 A; 200/16 C; 200/16 D

[58] Field of Search ..... 200/5 R, 5 A, 16 C, 200/16 D

[56] References Cited

U.S. PATENT DOCUMENTS

| | | | |
|---|---|---|---|
| 3,205,319 | 9/1965 | Anderson | 200/16 C |
| 3,584,162 | 6/1971 | Krakinowski | 200/5 A |
| 3,632,909 | 1/1972 | Rowley | 200/16 D |
| 3,786,206 | 1/1974 | Kurimsky | 200/16 D |
| 3,854,018 | 12/1974 | Reynolds et al. | 200/16 D X |
| 3,909,564 | 9/1975 | Scheingold et al. | 200/5 A X |
| 3,963,884 | 6/1976 | Pollock | 200/16 D |
| 4,012,608 | 3/1977 | Lockard | 200/16 D |

OTHER PUBLICATIONS

Technical Disclosure Bulletin, vol. 22, No. 6, Nov., 1979, IBM Corporation.

*Primary Examiner*—S. J. Witkowski

*Attorney, Agent, or Firm*—Senniger, Powers, Leavitt and Roedel

[57] ABSTRACT

A slide selector switch device comprising a membrane switch having a base layer, an intermediate layer and a cover layer of electrical insulation material, the intermediate layer having a plurality of sets of openings arranged in straight lines, the base and cover layers each having an electrically conductive switching and circuit pattern on its inside face including contact areas at the openings and circuits each adapted to be made on electrical contact of the contact areas at a respective opening, a slide guide overlying the cover layer, and slides, one for each of said sets of openings, each slidable along a respective line to a plurality of different positions for depressing the portion of the cover layer at a respective opening to make the respective circuit.

15 Claims, 8 Drawing Figures

SLIDE SELECTOR SWITCH DEVICE

BACKGROUND OF THE INVENTION

This invention relates to slide selector switch devices, and more particularly to a matrix type slide selector switch device particularly useful in a vending machine for setting prices at which different items are to be vended, although not limited to such use.

Reference may be made to U.S. Pat. No. 3,205,319 showing a slide selector switch device of a type which has been extensively used, inter alia, as a price setting unit in multi-product vending machines, and also to U.S. Pat. No. 3,786,206 showing a so-called price board slide switch specifically identified as for price setting in a multi-product vending machine. This invention is in the same general category as the devices shown in these patents, and may be regarded as involving improvements over them.

SUMMARY OF THE INVENTION

Among the several objects of the invention may be noted the provision of an improved slide selector switch device, particularly useful in a vending machine for setting prices at which different items are to be vended although not limited to such use, which is of simplified construction and which may be produced at much lower cost than prior slide selector switches such as that shown in U.S. Pat. No. 3,205,319; and the provision of such a switch device in which the contacts are totally sealed and thus protected from the atmosphere and incursion of dirt.

The invention takes advantage of the membrane type of switch which has come into use, a slide selector switch device of the invention generally including membrane switch means comprising a base layer, an intermediate layer, and a cover layer each of electrical insulation material, the layers being secured together with the intermediate layer sandwiched between the base and cover layers. The intermediate layer has a series of openings therein arranged in a line and spaced at intervals from one another along said line. Each of the base and cover layers has an electrically conductive switching and circuit pattern on its inside face including contact areas at the openings in the intermediate layer. Portions of the cover layer at the openings are elastically depressible into the openings for making electrical contact between the contact areas of the base and cover layers at the openings. The switching and circuit patterns form circuits each adapted to be made on electrical contact of the contact areas at a respective opening. A slide guide means overlies the cover layer of the membrane switch means, and a slide for depressing said portions of the cover layer into the openings is slidably guided by the guide for movement along the said line to a plurality of positions in each of which it depresses the portion of the cover layer at a respective opening in the intermediate layer into the respective opening for making the respective circuit.

Other objects and features wll be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
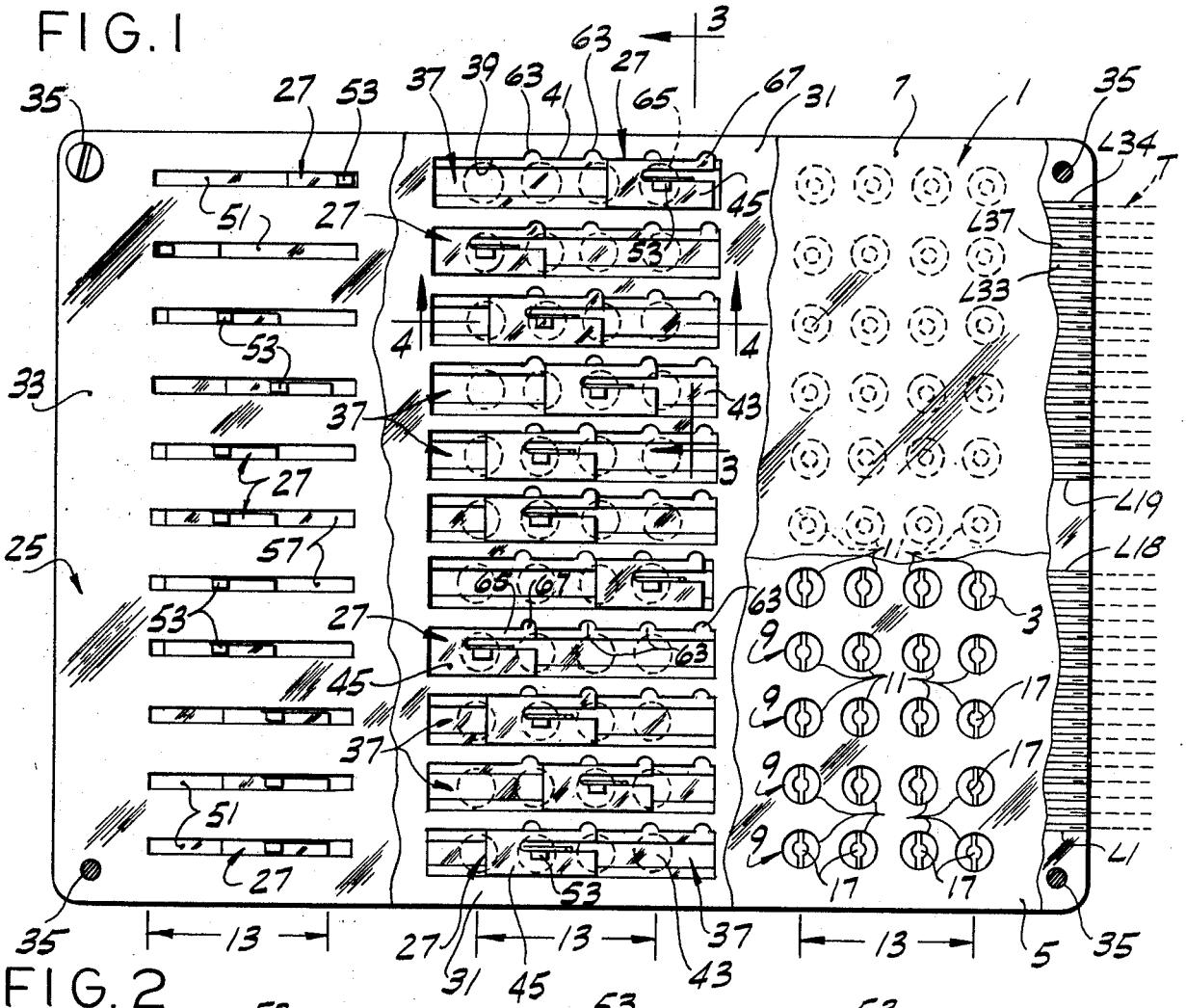
FIG. 1 is a plan of a slide selector switch device of this invention, with parts broken away and parts omitted.
Figure 2:
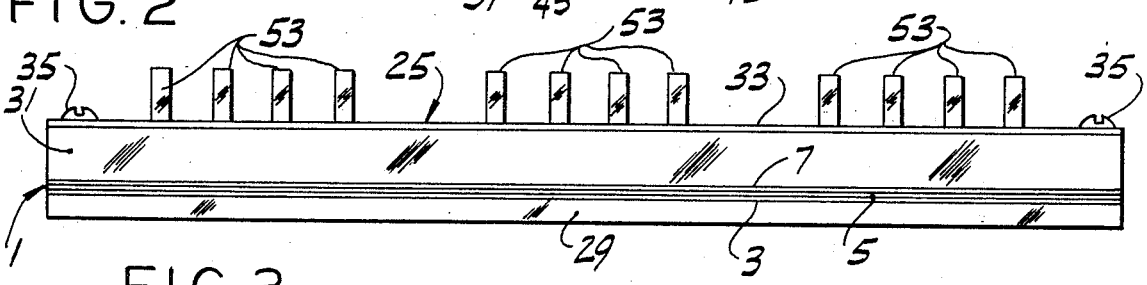
FIG. 2 is a side elevation of FIG. 1.
Figure 3:
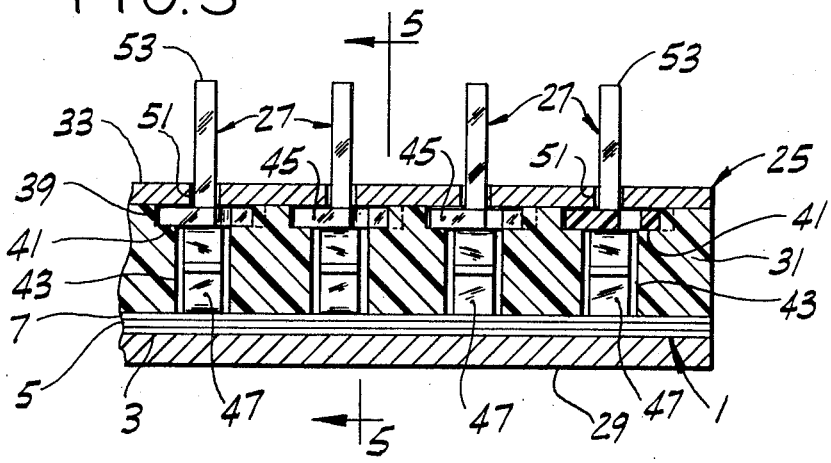
FIG. 3 is an enlarged section on line 3—3 of FIG. 1.
Figure 4:
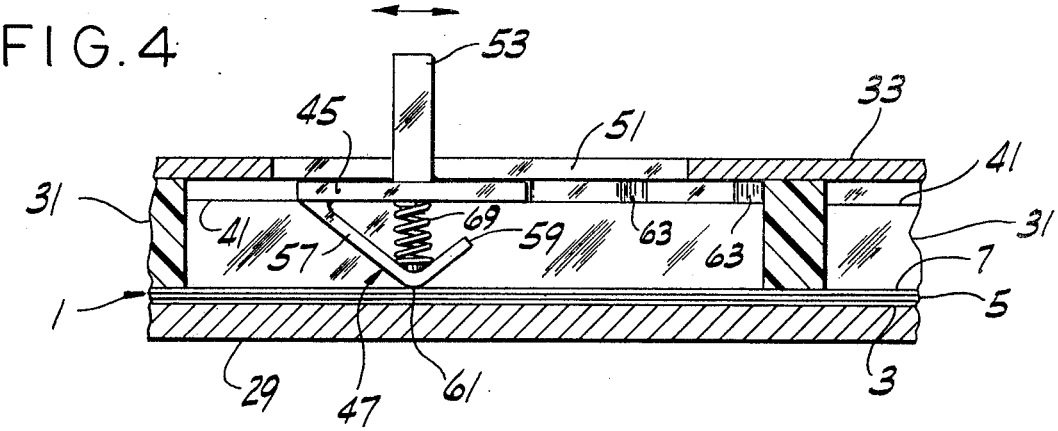
FIG. 4 is an enlarged section on line 4—4 of FIG. 1.
Figure 5:
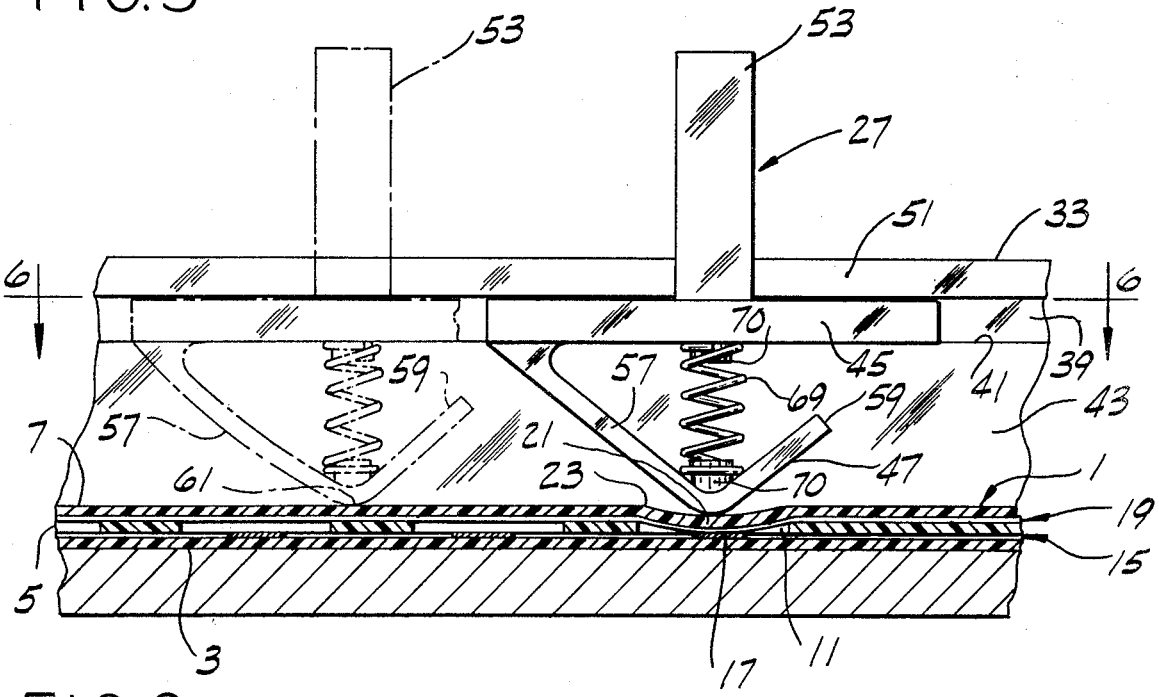
FIG. 5 is a section on line 5—5 of FIG. 3 further enlarged and showing in phantom a moved position of a slide of the device.
Figure 6:
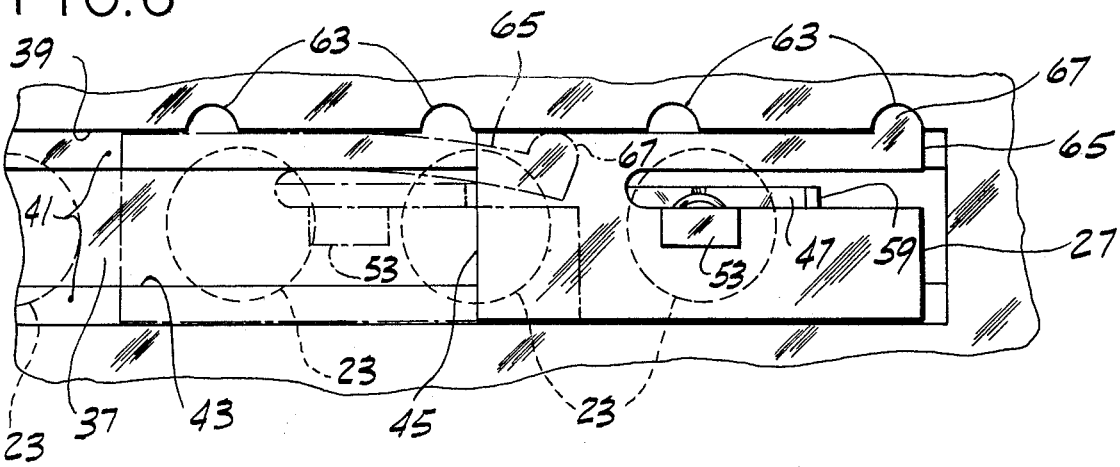
FIG. 6 is a horizontal section on line 6—6 of FIG. 5.

Referring to the drawings, a slide selector switch device of this invention comprises a membrane switch means indicated generally at 1 comprising a base layer 3, an intermediate or spacer layer 5 and a cover layer 7 each of electrical insulation material. The intermediate layer has at least one set of openings therein arranged in a straight line and spaced at intervals from one another along said line. As illustrated, the switch has thirty-three such sets of openings with four openings in each set, for a total of one hundred and thirty-two openings. Each set is designated 9, and each hole in each set is designated 11. The four openings in each set 9 may be referred to as the first to the fourth openings, reading from left to right in FIG. 1. The thirty-three sets are arranged in three groups each designated 13 in FIG. 1 with eleven sets in each of the three groups.

Each of the base and cover layers 3 and 7 has an electrically conductive switching and circuit pattern on its inside face including contact areas at the openings in the intermediate layer. The pattern on the base layer 3 is generally designated 15; the contact areas of this pattern are each designated 17. The pattern on the cover layer 7 is generally designated 19; the contact areas of this pattern are generally designated 21. As illustrated, there are one hundred and thirty-two sets of contact areas 17 and 21. Portions 23 of the cover layer 7 at the openings 11 are elastically depressible into the openings for making electrical contact between the contact areas 17 and 21 of the base and cover layers 3 and 7 at the openings. The switching and circuit patterns 15 and 19 form circuits (one hundred and thirty-two circuits as illustrated), each controlled by a pair of the contact areas 17 and 21 at a respective opening 11.

The pairs of contact areas 17 and 21 of the base and cover layers 3 and 7 are arranged in thirty-three sets 9, corresponding to the matrix arrangement of the openings 11, with each set having four pairs of contact areas (corresponding to the four openings 11 in each set 9 of openings.) A slide guide generally designated 25 overlies the cover layer 7 of the membrane switch means 1. A slide 27 is provided for each of the thirty-three sets 9 of openings 11 and pairs of contact areas 17 and 21 for depressing the depressible portions 23 of the cover layer 7 into the openings 11. Each slide 27 is slidably guided by the guide 25 for movement along a respective line of openings 11 (and pairs of contact openings 17 and 21) to a plurality of positions (four, as illustrated) in each of which it depresses the portion 23 of the cover layer 7 at a respective opening 11 in the intermediate layer 5 into the said respective opening for making the respective circuit.

In greater particularity, the slide selector switch device has a base plate 29, the membrane switch means 1 lying on this plate. The slide guide means 25 comprises a relatively thick guide plate 31 lying on the cover layer 7 of the membrane switch means 1 and a relatively thin cover plate 33 overlying the guide plate. The base plate 29, the membrane switch means 1, the guide plate 31 and the cover plate 33 are all rectangular, held together by screws 35 at the four corners.

The guide plate 31 has a plurality of slots 37, one for each of the thirty-three sets 9 of openings 11, each slot extending in line with a respective set 13. Each slot 37 is generally of T-shape in transverse cross section thereby having an upper relatively wide head or top portion 39, a pair of shoulders 41 at opposite sides thereof at the top, and a relatively narrow stem portion 43 extending down to the bottom of the plate 31. There is a slide 27 for each of the slots 37 (thirty-three in all), each slide having a body 45 overlying the shoulders 41 at opposite sides of the top of the slot and a spring finger 47 extending down in the stem portion 43 of the slot with the lower end of the finger 47 in spring engagement with the cover layer 7 of the membrane switch means 1 for depressing the depressible portions 23 of the cover layer into the openings 11 in the intermediate layer 5.

Each slide 27 is slidable along its respective slot 37 to a plurality of positions in each of which it depresses the depressible portion 23 of the cover layer 7 at a respective opening 11 in the intermediate layer 5 into the respective opening for making the respective circuit provided by the switching and circuit patterns on the base and cover layers 3 and 7 of the membrane switch means 1. The cover plate 33 has a plurality of slots 51, one for each of the slots 37 in the guide plate 31, in register with the slots 37 in the guide plate 31 and narrower than the top 39 of the slots 37 in the guide plate, whereby the cover plate holds the slide bodies 45 in the tops 39 of the slots 37 while permitting the slide bodies to slide to the different positions along the slots. Each slide body 45 has a tab 53 extending up therefrom through the respective slot 51 in the cover plate 33 for manually sliding the slide to its different positions.

The guide plate 31 and each slide 27 have cooperable detent means generally designated 55 for retaining the slide in each of its positions (of which there are four in all). In the preferred construction of the device, each slide is a molded plastic element with the spring finger 47 and the tab 53 integral with the body 45 of the slide, the spring finger being generally of V-shape with one arm 57 of the V longer than the other arm 59 and inclined downward from the bottom of the body 45 of the slide in the plane of the line of the four openings 11 in a set 9 of openings. The height of the spring finger, i.e., the vertical distance from the bottom of the body 45 of the slide to the apex 61 of the finger, in the initial as-molded condition of the finger is somewhat greater than the vertical distance between the shoulders 41 and the upper surface of the cover layer 7 of the membrane switch means 1, and the finger is thereby held in sprung-up condition bearing down on cover layer 7 as it slides between depressible portions 23 of the cover layer at the openings 11 in the intermediate layer 5 of the membrane switch means, and springs down when it reaches a depressible portion 23 to push it down for contact purposes. The detent means 55 comprises a series of four notches 63 spaced at intervals along one side of the top 39 of the respective slot 37, and a spring detent finger 65 integral with the body 45 of the slide at this side of the slide having a button 67 engageable in the notches. A coil compression spring 69 is preferably provided between the body 45 of the slide and the spring finger 47 biasing the latter down, the ends of the spring being received on pins such as indicated at 70 molded integrally on the body 45 and finger 47.

The cover layer 7 of the membrane switch means 1 comprises a flexible sheet of a plastic material which retains its flexibility at the depressible portions 23 thereof at the openings 11 in the intermediate layer even under relatively prolonged pressure of the spring finger 47 of a slide 27 on said portions. It is presently preferred that the cover layer 7 and also the intermediate layer 5 and base layer 3 of the membrane switch means be made of a polyimide resin such as that sold under the trade designation Kapton by E. I. duPont de Nemours and Company, this material having been found capable of retaining flexibility as aforesaid. Each of the three layers may be 0.007 inch thick, for example, and sealed together, after the printing of the switching and circuit patterns on the base and cover layers, by coating the layers with fluorinated ethylene propylene resin such as that sold under the trade designation FEP Teflon by E. I. duPont de Nemours and Company, and heating the assembled layers at about 240° C. under suitable pressure for a sufficient length of time to effect sealing. The patterns may be provided by well-known copper etch or conductive ink spraying techniques.

Figure 7:
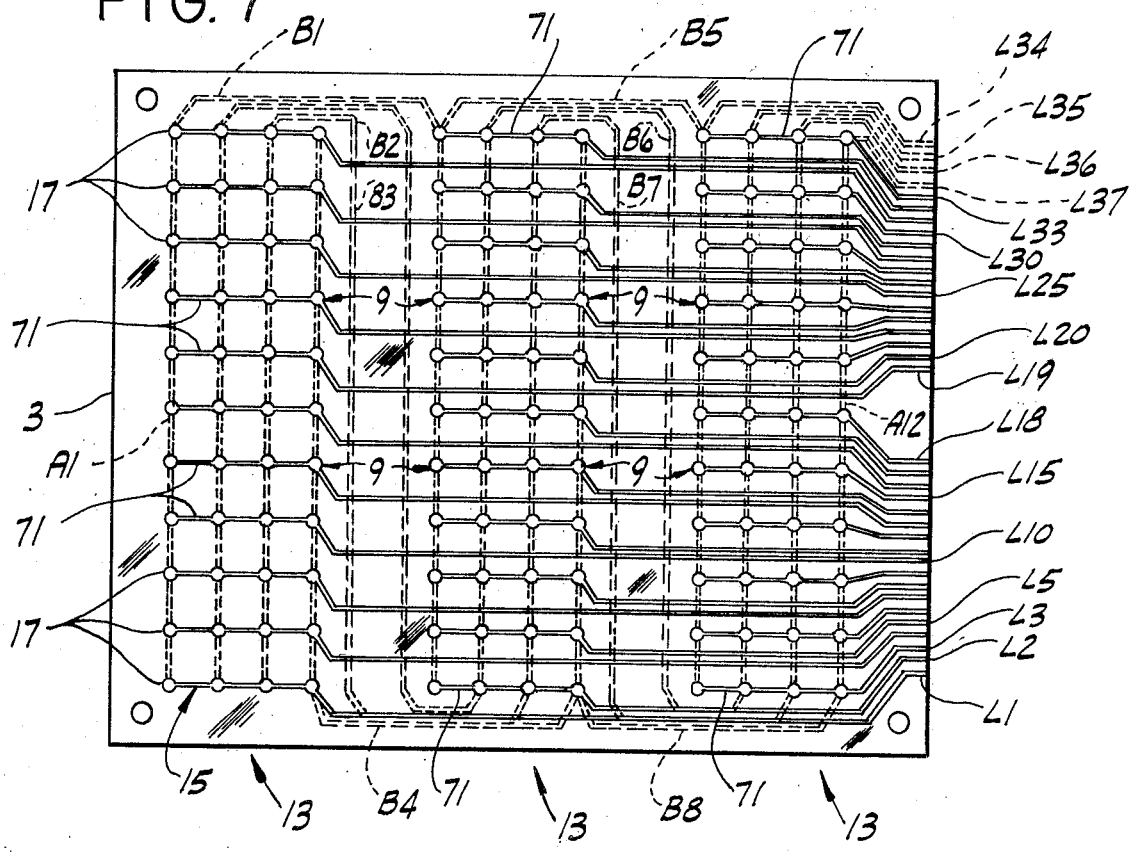
FIGS. 7 and 8 are views illustrating switching and circuit patterns on the inside faces of base and cover layers, respectively, of a membrane switch means of the device, FIG. 7 showing in dotted lines the location of the pattern on the cover layer of FIG. 8 as assembled with the base layer of FIG. 7.
Figure 8:
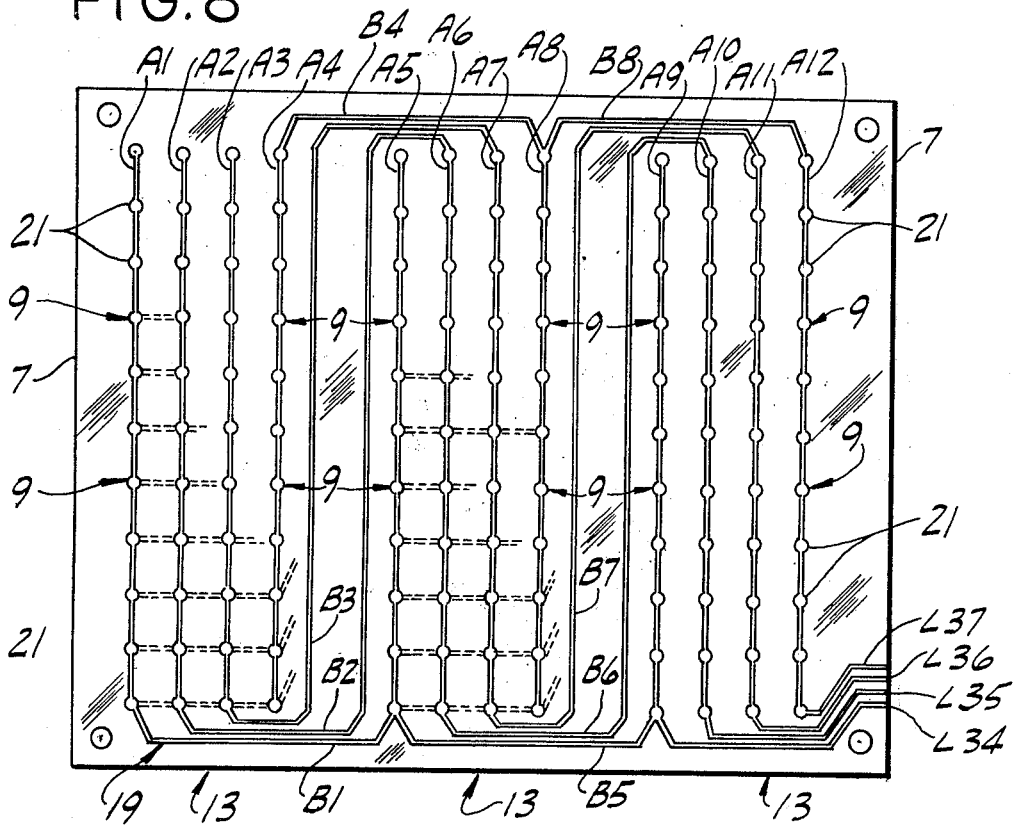

Referring to FIG. 7, it will be observed that the switching and circuit pattern on the base layer 3 of the membrane switch means 1 comprises thirty-three sets 9 of contact areas 17, four in each set, arranged in correspondence with the openings 11 in the intermediate layer 5 of means 1. Thus, there are three groups 13 of eleven sets each of contact areas 17. The four contact areas in each set are electrically interconnected as indicated at 71, and the thirty-three sets have leads such as indicated at L1–L33 extending to an edge of the membrane switch means 1 (its right edge as shown in FIGS. 1 and 7) having terminals such as indicated at T in FIG. 1 extending out from said edge. The switching and circuit pattern on the cover layer 7 of the membrane switch means 1 similarly comprises thirty-three sets of contact areas 21, four in each set, arranged in correspondence with the openings 11 (and the contact areas 17). Thus, there are three groups 13 of eleven sets each of contact areas 21. The contact areas 21 of the three groups line up in twelve lines A1–A12 as indicated in FIG. 8. The contact areas in each of these lines are electrically interconnected, also as indicated at A1–A12, with further electrical interconnections between these lines as follows: A1 and A5, A2 and A6, A3 and A7, A4 and A8, A5 and A9, A6 and A10, A7 and A11, and A8 and A12, as indicated at B1–B8, respectively. Leads L34–L37 interconnected with A9–A12 extend to the right edge of the membrane switch means and have terminals such as indicated at T in FIG. 1 extending out from said edge.

In the utilization of the slide selector switch device in a vending machine, the thirty-three pairs of contacts 17, 21, the interconnections 71 on layer 3, the interconnections A1–A12 and B1–B8 on layer 7, the thirty-three leads L1–L33 on layer 3 and the four leads L34–L37 on layer 7 provide for setting four different prices for each of thirty-three different items to be vended. Each of the thirty-three sets 9 of four contact pairs 17, 21 and the respective slide 27 controls the vending of a particular item at one of four different prices, the price depending on the setting of the slide 27. The slide is adapted to be set in any one of four positions, as determined by engagement of the button 65 on the spring detent finger 67 of the slide in the detent notches 63. The positions may be referred to as the first to the fourth positions, reading from left to right in FIG. 1. As shown for the set at the top of the central group 13 in FIG. 1, for example, the slide 27 is in its fourth position. The apex 61 of the spring finger 47 of this slide is thereby located in its fourth position and held therein generally at the center of the fourth opening 11 of the set, and depresses the portion 23 of the cover layer 7 of the membrane switch means 11 into said opening 11 to make electrical contact between the respective contact areas 17 and 21. Referring to FIG. 7, it will be observed that this makes a circuit between L32 and L37. If the slide is set in the third position, a circuit is made between L32 and L36; if set in the second position, a circuit is made between L32 and L35; and if set in the first position, a circuit is made between L32 and L34. The circuits made on settings of the other slides in their various positions may be readily ascertained from FIGS. 7 and 8, noting that in the first position of each slide, it closes the first pair of contacts 17, 21 of the respective set 9, in the second position, it closes the second pair, in the third position it closes the third pair, and in the fourth position it closes the fourth pair. As one more example, the slide for the set at the bottom of the central group in FIG. 1 is shown set in its second position closing the second pair of contacts of this set; this makes a circuit between L2 and L35. With the thirty-three leads L1–L33 and the four leads L34–L37 there are one hundred and thirty two combinations in all.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A slide selector switch device comprising:

membrane switch means comprising a base layer, an intermediate layer, and a cover layer each of electrical insulation material;

the layers being secured together with the intermediate layer sandwiched between the base and cover layers;

the intermediate layer having a plurality of openings therein arranged in a matrix defined by the points of intersection of a set of first generally parallel lines with a set of second generally parallel lines, the base and cover layers each having an electrically conductive switching and circuit pattern on its inside face including contact areas at the openings in the intermediate layer, the membrane switch means further comprising a plurality of leads, one lead for each of said lines, extending to an edge of the membrane switch means, the electrically conductive switching and circuit pattern on the cover layer including a first plurality of conductors, one for each of said first lines, each conductor electrically interconnecting the contact areas along the respective first line and the respective lead, the pattern on the base layer including a second plurality of conductors, one for each of said second lines, each conductor electrically interconnecting the contact areas along the respective second line and the respective lead, portions of the cover layer at the openings being elastically depressible into the openings for making electrical contact between the contact areas of the base and cover layers at the openings, said switching and circuit patterns forming circuits between the leads for the first lines and the leads for the second lines, each circuit being adapted to be made on electrical contact of the contact areas at a respective opening, slide guide means overlying the cover layer of the membrane switch means, and a plurality of slides, one for each line of one of said sets of lines, for depressing said portions of the cover layer into the openings, each slide being slidably guided by the guide means for movement along the respective line of said one set of lines to a plurality of positions in each of which it depresses the portion of the cover layer at a respective opening in the intermediate layer into the respective opening for making the circuit between the respective leads.

2. A slide selector switch device as set forth in claim 1 wherein each slide has a spring finger for depressing respective portions of the cover layer into said openings.

3. A slide selector switch device as set forth in claim 2 wherein the guide means and each slide have cooperable detent means for retaining the slide in each of its said positions.

4. A slide selector switch device as set forth in claim 3 wherein each slide is slidable in a slot in the guide means and has a tab extending out of the slot for manually sliding the slide to its said different positions.

5. A slide selector switch device as set forth in claim 4 wherein the spring finger of each slide has an end adapted to slide on the cover layer of the membrane switch means and to spring in on reaching any one of its respective portions of the cover layer for depressing said portions into the openings in the intermediate layer.

6. A slide selector switch device as set forth in claim 5 wherein the detent means for each slide comprises a spring detent finger on the slide at one side thereof having a detent button thereon, and a series of detent notches spaced at intervals along the respective slot at its said one side, the button being engageable in the notches.

7. A slide selector switch as set forth in claim 1 wherein the cover layer of the membrane switch means comprises a flexible sheet of a plastic material which retains its flexibility at the said cover layer portions at the openings in the intermediate layer even under relatively prolonged pressure of the slides on said portions.

8. A slide selector switch as set forth in claim 7 wherein the cover layer is a flexible sheet of polyimide resin.

9. A slide selector switch as set forth in claim 8 wherein the base and intermediate layers are also sheets of polyimide resin.

10. A slide selector switch device comprising:

a base plate, a membrane switch means on the base plate, said membrane switch means comprising a base layer on the base plate, an intermediate layer, and a cover layer each of electrical insulation material, said layers being secured together with the intermediate lyer sandwiched between the base and cover layers, the intermediate layer having a plurality of openings therein arranged in a matrix defined by the points of intersection of a set of first generally parallel lines with a set of second generally parallel lines, the base and cover layers each having an electrically conductive switching and circuit pattern on its inside face including contact areas at the openings in the intermediate layer, the membrane switch means further comprising a plurality of leads, one lead for each of said lines, extending to an edge of the membrane switch means, the electrically conductive switching and circuit pattern on the cover layer including a first plurality of conductors, one for each of said first lines, each conductor electrically interconnecting the contact areas along the respective first line and the respective lead, the pattern on the base layer including a second plurality of conductors, one for each of said second lines, each conductor electrically interconnecting the contact areas along the respective second line and the respective lead, portions of the cover layer at the openings being elastically depressible into the openings for making electrical contact between the contact areas of the base and cover layers at the openings, said switching and circuit patterns forming circuits between the leads for the first lines and the leads for the second lines, each circuit being adapted to be made on electrical contact of the contact areas at a respective opening, slide guide means overlying the cover layer of the membrane switch means, said slide guide means comprising a guide plate on the cover layer having a plurality of slots, one for each line of one of said sets of lines, each slot extending parallel to its respective line and being generally of T-shape in transverse cross section and thereby having a pair of shoulders at opposite sides thereof at the top, a plurality of slides, one for each slot, each slide having a body overlying the shoulders at opposite sides of the slot and a spring finger extending down in the slot with the lower end of the finger in engagement with the cover layer for depressing the said portions of the cover layer into said openings, each slide being slidable along the respective slot to a plurality of positions in each of which it depresses the portion of the cover layer at a respective opening in the intermediate layer into the respective opening for making the circuit between the respective leads, said slide guide means further comprising a cover plate overlying the guide plate having a plurality of slots, one for each of the slots in the guide plate, in register with the slots in the guide plate and narrower than the top of the slots in the guide plate for holding the slide bodies in the tops of the slots in the guide plate while permitting the slide bodies to slide, each slide body having a tab extending therefrom through the respective slot in the cover plate for manually sliding the slide to its said different positions.

11. A slide selector switch device as set forth in claim 10 wherein the guide means and each slide have cooperable detent means for retaining the slide in each of its positions.

12. A slide selector switch as set forth in claim 11 wherein each slide is a molded plastic element with the spring finger and tab integral with the body, the detent means for each slide comprising a series of notches spaced at intervals along one side of the top of the respective slot and a spring detent finger integral with the body of the slide at said one side of the slide having a button engageable in the notches.

13. A slide selector switch as set forth in claim 10 wherein the cover layer of the membrane switch means comprises a flexible sheet of a plastic material which retains its flexibility at said cover layer portions at the openings in the intermediate layer even under relatively prolonged pressure of the slides on said portions.

14. A slide selector switch as set forth in claim 13 wherein the cover layer is a flexible sheet of polyimide resin.

15. A slide selector switch as set forth in claim 14 wherein the base and intermediate layers are also sheets of polyimide resin.

* * * * *